US010119729B2

(12) United States Patent
Derosier

(10) Patent No.: US 10,119,729 B2
(45) Date of Patent: Nov. 6, 2018

(54) EVAPORATOR LIQUID PREHEATER FOR REDUCING REFRIGERANT CHARGE

(71) Applicant: Evapco, Inc., Taneytown, MD (US)

(72) Inventor: Greg Derosier, Eldersburg, MD (US)

(73) Assignee: Evapco, Inc., Taneytown, MD (US)

( * ) Notice: Subject to any disclaimer, the term of this patent is extended or adjusted under 35 U.S.C. 154(b) by 140 days.

(21) Appl. No.: 14/789,910

(22) Filed: Jul. 1, 2015

(65) Prior Publication Data

US 2016/0178243 A1 Jun. 23, 2016

Related U.S. Application Data

(60) Provisional application No. 62/019,877, filed on Jul. 1, 2014.

(51) Int. Cl.
*F25B 5/04* (2006.01)
*F25B 41/00* (2006.01)
(Continued)

(52) U.S. Cl.
CPC ..... *F25B 5/04* (2013.01); *F25B 6/04* (2013.01); *F25B 39/02* (2013.01); *F25B 40/00* (2013.01); *F25B 41/00* (2013.01); *F25B 49/02* (2013.01); *F25B 5/02* (2013.01); *F25B 2339/047* (2013.01); *F25B 2400/05* (2013.01); *F25B 2400/23* (2013.01); *F25B 2500/19* (2013.01); *F25B 2700/197* (2013.01); *F25B 2700/1933* (2013.01); *F25B 2700/21151* (2013.01); *F25B 2700/21175* (2013.01)

(58) Field of Classification Search
CPC .. F25B 5/04; F25B 41/00; F25B 39/02; F25B 49/02; F25B 40/00; F25B 6/04; F25B 2400/05; F25B 5/02; F25B 2400/23; F25B 2700/21151; F25B 2339/047; F25B 2700/21175; F25B 2700/197; F25B 2700/1933
USPC ..... 62/115, 513, 526
See application file for complete search history.

(56) References Cited

U.S. PATENT DOCUMENTS 2,051,971 A 8/1936 Swart
2,938,362 A * 5/1960 Schwind ..... F25B 9/006 62/102

(Continued)

OTHER PUBLICATIONS

International Search Report issued in corresponding International Application No. PCT/US2015/038911 dated Oct. 7, 2015.

(Continued)

*Primary Examiner* — Ljiljana Ciric
*Assistant Examiner* — Kirstin Oswald
(74) *Attorney, Agent, or Firm* — Whiteford, Taylor & Preston, LLP; Peter J. Davis

(57) ABSTRACT

A system and method for reducing the refrigerant charge in a refrigeration system by preheating the liquid refrigerant before it is introduced to the evaporator inlet. When refrigerant liquid is introduced to the evaporator inlet, a portion of the refrigerant liquid vaporizes. This refrigerant vapor displaces refrigerant liquid at the inlet of the evaporator. As more refrigerant vapor is introduced, the amount of liquid inside the evaporator is reduced. A heat exchanger is placed before the liquid refrigerant inlet of the evaporator to generate more vapor when the refrigerant enters the evaporator.

6 Claims, 3 Drawing Sheets

(51) Int. Cl.

| | |
|---|---|
| ***F25B 39/02*** | (2006.01) |
| ***F25B 6/04*** | (2006.01) |
| ***F25B 40/00*** | (2006.01) |
| ***F25B 49/02*** | (2006.01) |
| *F25B 5/02* | (2006.01) |

(56) References Cited

U.S. PATENT DOCUMENTS 3,064,445 A * 11/1962 Gerteis ..... F25B 41/062 62/149
3,164,973 A 1/1965 Watkins
3,664,150 A * 5/1972 Patterson ..... F25B 5/02 62/152
3,786,651 A * 1/1974 Eschbaugh ..... F25B 41/062 236/92 B
3,967,782 A * 7/1976 Eschbaugh ..... F25B 41/062 236/92 B
4,096,706 A * 6/1978 Beckwith ..... F25B 1/00 62/115
4,972,678 A 11/1990 Finlayson
5,095,712 A * 3/1992 Narreau ..... F25B 1/10 62/113
5,329,782 A 7/1994 Hyde
5,454,228 A * 10/1995 Yang ..... F25B 39/04 62/113
5,509,272 A * 4/1996 Hyde ..... F24F 3/153 62/176.5
5,544,496 A 8/1996 Stoll et al.
5,867,993 A 2/1999 Dube
5,921,098 A * 7/1999 Schmidt ..... F25B 41/062 62/202
2003/0010046 A1* 1/2003 Freund ..... F25B 49/02 62/222
2008/0314064 A1* 12/2008 Al-Eidan ..... F25B 13/00 62/324.6
2009/0105889 A1* 4/2009 Cowans ..... F25B 40/00 700/299
2014/0260376 A1* 9/2014 Kopko ..... F25D 3/005 62/99

OTHER PUBLICATIONS

Supplementary European Search Report issued in co-pending European Patent Application No. 15815973 dated Jan. 29, 2018.

* cited by examiner

EVAPORATOR LIQUID PREHEATER FOR REDUCING REFRIGERANT CHARGE

BACKGROUND OF THE INVENTION

Field of the Invention

The present invention relates to refrigeration systems employing a compressor, condenser and evaporator and more particularly to such systems employing a volatile refrigerant circulated by the compressor; and still more particularly to such systems of the so-called liquid overfeed type of refrigeration system, but the invention may also be used with a direct expansion refrigeration system.

Background of the Invention

The vapor-compression uses a circulating liquid refrigerant as the medium which absorbs and removes heat from the space to be cooled and subsequently rejects that heat elsewhere. All such systems have a compressor, a condenser, an expansion valve (also called a throttle valve or metering device), and an evaporator. Circulating refrigerant enters the compressor in the thermodynamic state known as a saturated vapor and is compressed to a higher pressure, resulting in a higher temperature as well. The hot, compressed vapor is then in the thermodynamic state known as a superheated vapor, and it is at a temperature and pressure at which it can be condensed with either cooling water or cooling air. That hot vapor is routed through a condenser where it is cooled and condensed into a liquid by flowing through a coil or tubes with cool water or cool air flowing across the coil or tubes. This is where the circulating refrigerant rejects heat from the system and the rejected heat is carried away by either the water or the air (whichever may be the case).

The condensed liquid refrigerant, in the thermodynamic state known as a saturated liquid, is next routed through an expansion valve where it undergoes an abrupt reduction in pressure. That pressure reduction results in the adiabatic flash evaporation of a part of the liquid refrigerant. The auto-refrigeration effect of the adiabatic flash evaporation lowers the temperature of the liquid and vapor refrigerant mixture to where it is colder than the temperature of the enclosed space to be refrigerated.

The cold mixture is then routed through the coil or tubes in the evaporator. A fan circulates the warm air in the enclosed space across the coil or tubes carrying the cold refrigerant liquid and vapor mixture. That warm air evaporates the liquid part of the cold refrigerant mixture. At the same time, the circulating air is cooled and thus lowers the temperature of the enclosed space to the desired temperature. The evaporator is where the circulating refrigerant absorbs and removes heat which is subsequently rejected in the condenser and transferred elsewhere by the water or air used in the condenser. To complete the refrigeration cycle, the refrigerant vapor from the evaporator is again a saturated vapor and is routed back into the compressor.

SUMMARY OF THE INVENTION

The invention is a system and method for reducing the refrigerant charge in a refrigeration system, specifically by reducing the required refrigerant charge in the evaporator by preheating the liquid refrigerant before it is introduced to the evaporator inlet. When refrigerant liquid is introduced to the evaporator inlet, a portion of the refrigerant liquid vaporizes. This refrigerant vapor displaces refrigerant liquid at the inlet of the evaporator. As more refrigerant vapor is introduced, the amount of liquid inside the evaporator is reduced. According to the present invention, a heat exchanger placed before the liquid refrigerant inlet of the evaporator. This heat exchanger is used to pre-heat the liquid to generate more vapor when the refrigerant enters the evaporator. The increased amount of vapor entering the evaporator (relative to prior art systems), displaces the liquid refrigerant, thus reducing the refrigerant charge required for the evaporator, and thus, for the overall system. According to one embodiment, the liquid refrigerant may be heated in order to fully vaporize 5%-30% of the refrigerant. According to related embodiments, the liquid refrigerant may be heated in order to full vaporize 10%-30% of the refrigerant, 15%-30% of the refrigerant, 20%-30% of the refrigerant, 5%-10% of the refrigerant, 5%-15% of the refrigerant, or 10%-20% of the refrigerant.

According to another embodiment, the liquid refrigerant may be heated to a temperature that is between 10% and 80% of the difference between the operating temperatures of the condenser and the evaporator. For example, if the condenser is operating at 90° F. and the evaporator is operating at 30° F., the temperature difference is 60° F., and the liquid refrigerant may be warmed to 36° F. (10% of the temperature difference) or to 78° F. (80% of the difference, or anywhere in between 36° F. and 78° F. According to related embodiments, the liquid refrigerant may be heated to a temperature that is 20%, 30%, 40%, 50%, 60% or 70% of the difference between the operating temperature of the condenser and the evaporator.

The heat exchanger heat source can be an external energy input such as waste heat produced by a refrigeration compressor, or an internal heat source such as the warm refrigerant liquid that exits from the condenser in the refrigeration system. By using warm liquid from the condenser, the net energy required to produce cooling is not increased. This arrangement is preferred when the liquid refrigerant flow to the evaporator is of the liquid overfeed type where a portion of the introduced refrigerant liquid exits the evaporator in a liquid state.

Any type of heat exchanger that can increase the temperature of a refrigerant liquid can be used. A liquid to liquid heat exchanger is preferred especially for a liquid overfeed evaporator. Fusion bonded plate heat exchangers such as manufactured by Alfa Laval are especially suited for this purpose.

DETAILED DESCRIPTION

Figure 1:
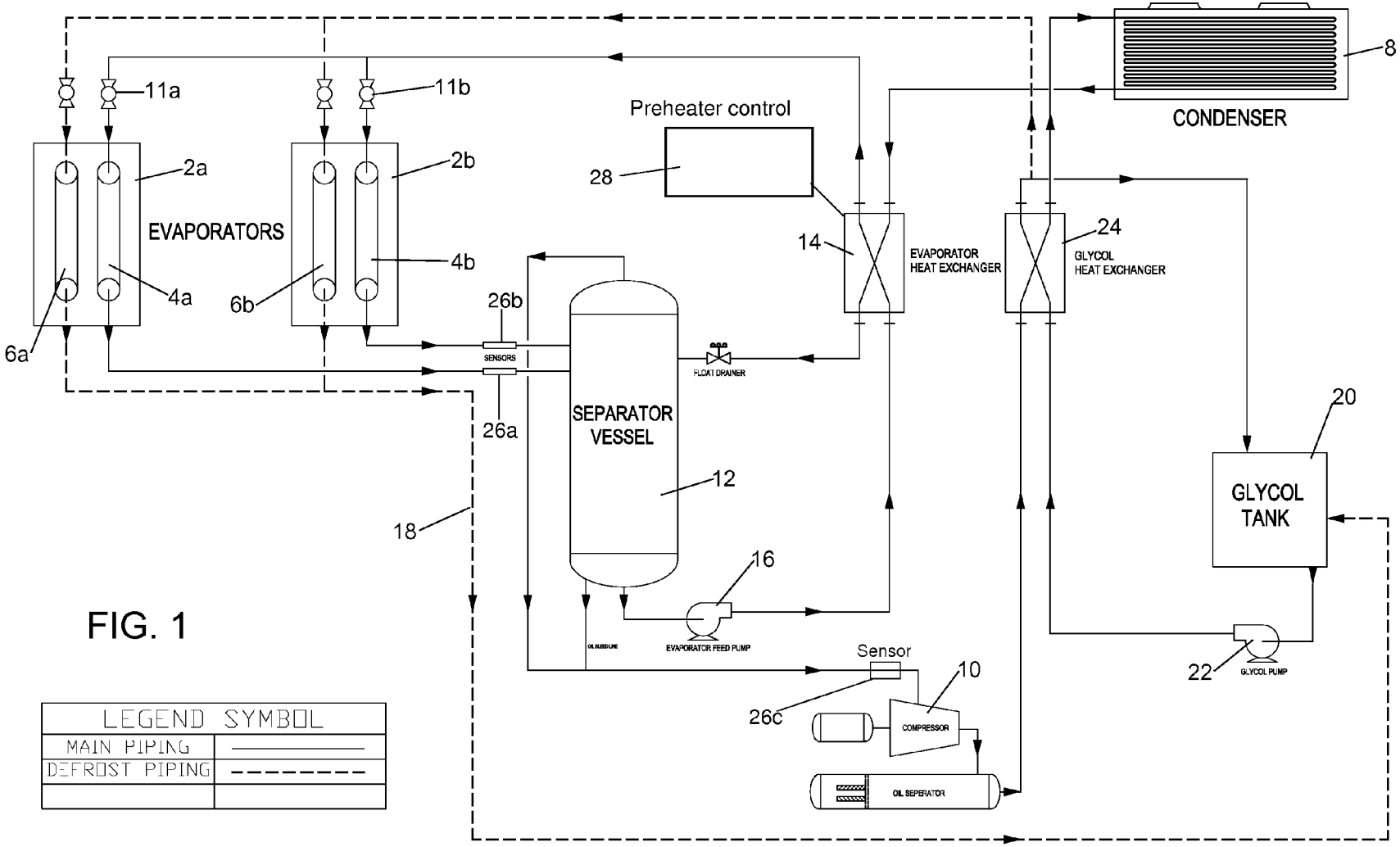
FIG. 1 is a schematic of a refrigeration system according to an embodiment of the invention.
Figure 2:
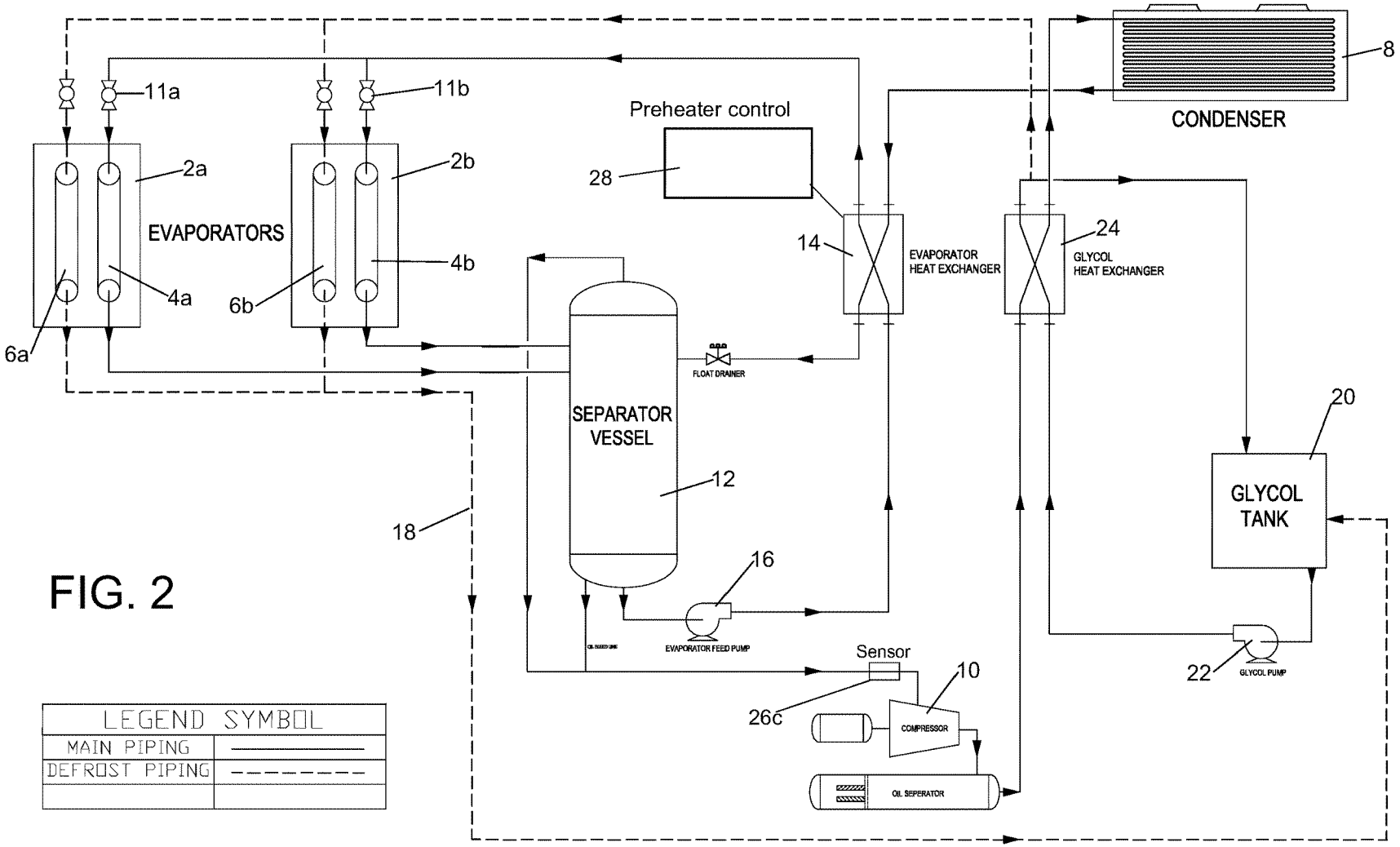
FIG. 2 is a schematic of a refrigeration system according to a second embodiment of the invention.
Figure 3:
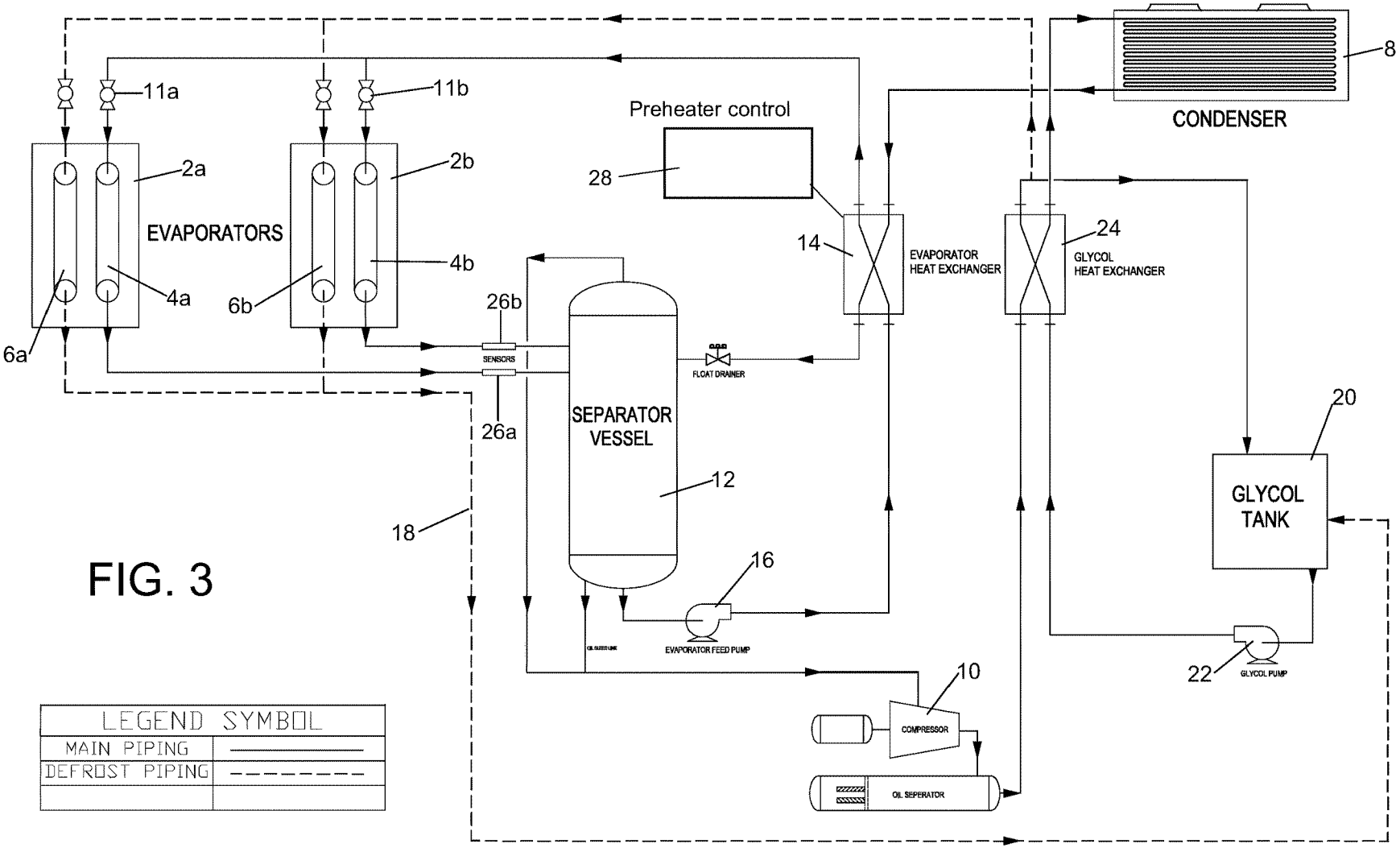
FIG. 3 is a schematic of a refrigeration system according to a third embodiment of the invention.

FIG. 1 shows a piping schematic showing an evaporator heat exchanger according to an embodiment of the invention in relation to other components in a liquid overfeed system. This is a preferred piping arrangement to maximize refrigeration system efficiency. The system includes evaporators 2*a* and 2*b*, including evaporator coils 4*a* and 4*b*, respectively, and defrost/glycol coils 6*a* and 6*b*, respectively, condenser 8, compressor 10, expansion devices 11*a* and 11*b* (which may be valves, metering orifices or other expansion devices), and separator vessel 12. The foregoing elements may be connected using standard refrigerant tubing in the manner shown in FIG. 1, or according to any standard arrangement. Defrost system 18 includes glycol tank 20, glycol pump 22, glycol heat exchanger 24 and glycol coils 6*a* and 6*b*, also connected to one-another and the other element of the system using refrigerant tubing according to the arrangement shown in FIG. 1, or according to any standard arrangement. According to the invention, evaporator pre-heater heat exchanger 14 is located before (upstream of) the inlet to the evaporators 2*a* and 2*b* to preheat the liquid refrigerant prior to introduction to the evaporator inlet. The energy required to preheat the liquid refrigerant may be provided by a source internal to the system, such as heated refrigerant leaving the condenser 8, as shown in FIG. 1. An evaporator feed pump 16 may also be provided to provide the additional energy necessary to force the refrigerant through the evaporator heat exchanger. According to one embodiment, the evaporator feed pump may be selected and configured to increase the pressure of the liquid refrigerant to 100 psi or greater in order to prevent an excess amount of refrigerant from vaporizing upon pre-heating.

By increasing the temperature of the liquid refrigerant at the evaporator inlet, more vapor is produced as the refrigerant enters the evaporator, thus reducing the required refrigerant charge per ton of refrigeration capacity. According to preferred embodiments, pre-heating the refrigerant prior to introduction of the refrigerant to the evaporator inlet will reduce the refrigerant charge per ton of refrigeration capacity by 10% and as much as 50%, relative to an identical system that does not include a refrigerant pre-heater. Other embodiments can reduce the refrigerant charge per ton of refrigeration capacity by 20%, by 30%, or by 40%.

Sensors 26*a* and 26*b* may be located downstream of said evaporators 2*a* and 2*b*, upstream of the inlet to the separator 12, to measure the temperature, pressure, and/or vapor/liquid ratio of refrigerant leaving the evaporators. According to alternative embodiments, sensor 26*c* may be located in the refrigerant line between the outlet of the separator 12 and the inlet to the compressor 10. Sensors 26*a*, 26*b* and 26*c* may be capacitance sensors of the type disclosed in U.S. Ser. Nos. 14/221,694 and 14/705,781, the disclosures of which are incorporated herein by reference, in their entirety. According to an embodiment of the invention, the evaporator pre-heater 14 may be controlled by a control system 28 that can be used to manually or automatically control the mount of pre-heat that is provided to the refrigerant flowing through the pre-heater. According to a preferred embodiment, control system 28 may be configured to control the amount of pre-heat applied to the refrigerant passing to the evaporator based on data, including refrigerant temperature, pressure and/or liquid/vapor ratio, received from said sensors 26*a*, 26*b*, and/or 26*c*.

The invention claimed is:

1. A liquid overfeed refrigeration system comprising:

a refrigerant evaporator, a refrigerant compressor, a refrigerant condenser, an expansion device, and a refrigerant pre-heater situated upstream of the inlet of the refrigerant evaporator, said refrigerant evaporator, refrigerant compressor, refrigerant condenser, expansion device and refrigerant pre-heater connected in a refrigerant flow path in the refrigeration system in the following order: 1) compressor—2) condenser—3) pre-heater—4) expansion device—5) evaporator—1) compressor, said refrigerant flow path also including a first sensor located between an outlet of the refrigerant evaporator and an inlet of the compressor to measure at least one of temperature, pressure and liquid vapor ratio of refrigerant leaving the refrigerant evaporator, and a preheater control system configured to control an amount of heat that is applied to refrigerant flowing through said refrigerant pre-heater to said refrigerant evaporator based on data received from said first sensor.

2. The refrigeration system according to claim 1, wherein said refrigerant pre-heater is a heat exchanger.

3. The refrigeration system according to claim 2, wherein a heat source for said preheater heat exchanger is warmed refrigerant liquid from said refrigerant condenser.

4. The refrigeration system according to claim 1, further comprising a separator element configured to separate liquid and vapor refrigerant leaving said evaporator.

5. The refrigeration system according to claim 1, further comprising an evaporator feed pump located in said refrigerant flow path upstream of between an outlet of the condenser and an inlet of the evaporator.

6. The refrigeration system according to claim 1, further comprising a defrost system.

* * * * *